US006604378B2

(12) United States Patent
Clodic

(10) Patent No.: US 6,604,378 B2
(45) Date of Patent: Aug. 12, 2003

(54) TURBO FAN DRIVEN BY EXPANSION OF A LIQUID OF A GAS

(75) Inventor: Denis Clodic, Paris (FR)

(73) Assignee: Armines, Paris Cedex (FR)

( * ) Notice: Subject to any disclaimer, the term of this patent is extended or adjusted under 35 U.S.C. 154(b) by 0 days.

(21) Appl. No.: 09/976,357

(22) Filed: Oct. 11, 2001

(65) Prior Publication Data

US 2002/0129611 A1 Sep. 19, 2002

Related U.S. Application Data

(63) Continuation of application No. PCT/FR00/00949, filed on Apr. 12, 2000.

(30) Foreign Application Priority Data

Apr. 12, 1999 (FR) ..... 99 04758

(51) Int. Cl.[7] ..... F25B 1/00

(52) U.S. Cl. ..... 62/498; 62/87; 62/404; 62/415; 62/428; 62/419

(58) Field of Search ..... 62/498, 87, 404, 62/415, 428, 419

(56) References Cited

U.S. PATENT DOCUMENTS

| | | | | | |
|---|---|---|---|---|---|
| 2,576,663 | A | | 11/1951 | Atchison | 62/4 |
| 3,934,424 | A | * | 1/1976 | Goldsberry | 62/87 |
| 4,170,116 | A | * | 10/1979 | Williams | 62/116 |
| 4,235,079 | A | * | 11/1980 | Masser | 62/87 |
| 4,235,080 | A | * | 11/1980 | Cassidy | 62/87 |
| 4,263,786 | A | * | 4/1981 | Eng | 62/87 |
| 4,292,814 | A | | 10/1981 | Braun | 62/243 |
| 4,442,682 | A | | 4/1984 | Sakata et al. | 62/401 |
| 5,918,472 | A | * | 7/1999 | Jonqueres | 62/87 |
| 6,272,871 | B1 | * | 8/2001 | Eisenhour | 62/225 |

FOREIGN PATENT DOCUMENTS

| | | |
|---|---|---|
| DE | 3715697 A1 | 5/1987 |
| EP | 0 176 149 A2 | 9/1985 |
| GB | 2 083 317 A | 8/1981 |
| JP | 54086842 | 7/1979 |

* cited by examiner

*Primary Examiner*—William C. Doerrler
*Assistant Examiner*—Mark S. Shulman
(74) *Attorney, Agent, or Firm*—Westman, Champlin & Kelly, P.A.

(57) ABSTRACT

This invention relates to refrigerating or air conditioning system comprising at least one exchanger (2, 3) The system uses a refrigerant fluid according to a thermodynamic cycle comprising at least one liquid-vapor expansion phase. According to the invention, the liquid-vapor expansion phase is created by means of a diphasic turbine (4*b*) that actuates a ventilator (5*b*), causing air to circulate on said exchanger (3).

19 Claims, 3 Drawing Sheets

TURBO FAN DRIVEN BY EXPANSION OF A LIQUID OF A GAS

CROSS-REFERENCE TO RELATED APPLICATION

This application is continuation application based on International Application No. PCT/FR00/00949, filed Apr. 12, 2000, and published as WO 00/61997 on Oct. 19, 2000 not in English.

FIELD OF THE INVENTION

This invention relates to systems, and particularly cooling systems such as domestic refrigerators or freezers, and fixed or mobile air conditioning systems. It relates to equipment for which exchangers work equally well in natural convection and in forced convection.

BACKGROUND OF THE INVENTION

Most refrigerator and freezer models operate in natural convection equally well for distribution of cooling inside the cooling compartment or outside this compartment to extract heat from the system. The corresponding natural convection coefficients are very low, between 3 and 5 W/m2.K. To transfer heat, these low coefficients of convection necessitate large exchange surface areas and large temperature differences between the exchanger and air, typically equal to 15 to 20 K. For example, a refrigerator with an average inside temperature of 5° C. located in a room at an ambient temperature equal to 25° C., giving a temperature difference of 20K, requires cooling cycles with evaporation temperatures of the order of −15 to −20° C. in the evaporator inside the compartment and condensation temperatures of 35° C. to 40° C. in the condenser outside the refrigerator. Therefore, the cycle operates with a temperature difference of 50 to 60K to maintain a useful difference of 20K.

It is known that fans can be used inside the compartment to reduce exchange surface areas, have better control over air circulation and to limit temperature differences between the evaporator and air inside the compartment. Similarly, it is also known that fans can be used to increase the exchange coefficients on the condenser, to ventilate the outside surface of the condenser. More generally, for air conditioning systems, fans are used both on the condenser and on the evaporator.

In all cases, the efficiencies of fan-motor units used for low power electrical fans (typically between 10 and 200 W) are low, typically the efficiency of electric drive motors is 10 to 15%, which introduces two types of consequences.

1. For exchangers with natural convection, the addition of a fan improves exchange coefficients and can reduce the difference between the phase change temperature of the cooling fluid and the average temperature of the air circulating over the exchanger. For the same temperature in the refrigerator, this increases the evaporation temperature, and for the same outside air temperature, it reduces the condensation temperature. This reduction in the difference between the evaporation and condensation temperatures, and therefore the corresponding evaporation and condensation pressures, reduces the consumption of the compressor. But the consumption of the fan is significantly greater than the saving of consumption of the compressor. The total consumption of the system (fans+compressor) is greater than the consumption of a compressor alone operating with natural convection exchangers.

2. For exchangers that already use forced convection such as air conditioning systems, and particularly onboard air conditioning systems, the proportion of the consumption of fans in the total energy consumption (compressor+fans) is very significant. For example, in automobile air conditioning, it can be as high as 35% of the total consumption.

SUMMARY OF THE INVENTION

The purpose of this invention is to improve the total energy balance (compressor+fans) of refrigeration or air conditioning systems for exchangers with natural convection or forced convection.

More particularly, this invention relates to systems using a fluid with a thermodynamic cycle comprising an expansion phase performed using a pressure reducer and a compression phase achieved using a compressor.

According to the invention, in this type of system, mechanical energy added to the two-phase circulating gas or liquid flow during the compression phase, can be recovered during a liquid-vapour expansion phase.

According to the invention, the liquid-vapour expansion phase is achieved through a two-phase turbine driving a fan causing air circulation over the said exchanger.

Preferably, in the case of a system using a sequence of devices comprising a compressor, a first exchanger acting as a condenser, a second exchanger acting as an evaporator, the system comprises a liquid-vapour expansion phase achieved using a two-phase turbine operating as a pressure reducer, activating a fan causing air circulation over the evaporator or over the condenser. Thus, mechanical energy recovered by replacing the usual pressure reducer in the form of an orifice or a capillary, by a two-phase expansion turbine operating as a pressure reducer comprising mobile elements and directly driving a fan wheel. The passage through the pressure reducer while performing external work also improves the global efficiency of the cycle.

Another preferred embodiment consists of a system using a sequence of devices comprising a compressor, a first exchanger acting as a condenser and a second exchanger acting as an evaporator, and this system comprises:

- a first turbine activating a first fan driving air circulation over the condenser,
- a second two-phase turbine acting as a pressure reducer and driving a second fan forcing air circulation over the evaporator.

The fan wheel is located either in the compartment to be cooled like the compartment in a refrigerator or a freezer, or outside it for example to ventilate exchange surfaces of the condenser of a refrigerator, or the heat exchange surfaces in air conditioning systems. In all cases, the two-phase pressure reduction turbine is located such that it can directly drive a fan wheel transferring the air flow over the exchange surface.

Advantageously, the system according to the invention is such that:

- the spindle of the turbine controlling the two-phase pressure reduction of the cooling fluid passes through the turbine body,
- a seal is provided at the joint between the turbine spindle and the body of the turbine to make it leak tight.

Also advantageously, in the case of another embodiment, the turbine controlling the two-phase pressure reduction of the cooling fluid drives the fan through a magnetic drive. This solves the problem of the seal between the turbine body and the turbine spindle.

In a process for the production of cold or heat using a cooling fluid with a thermodynamic cycle comprising at least one liquid-vapour expansion phase, the invention also relates to the characteristic step consisting of achieving the said liquid-vapour pressure reduction by means of a two-phase turbine activating a fan driving air circulation over an exchanger.

Other characteristics and advantages will become clear after reading the description of variant embodiments of the invention given for guidance, and that are in no way limitative.

DETAILED DESCRIPTION OF ILLUSTRATIVE EMBODIMENTS

The conventional cooling system is presented so that comparisons can be made with the system fitted with fan turbines, and for typical calculations of performance coefficients given as examples and demonstrating the energy savings resulting from the use of these fan turbines according to the invention. The cooling performance coefficient is the ratio of the cooling power produced Qo to the mechanical work W input, namely COPf=Qo/W.

Figure 1B:
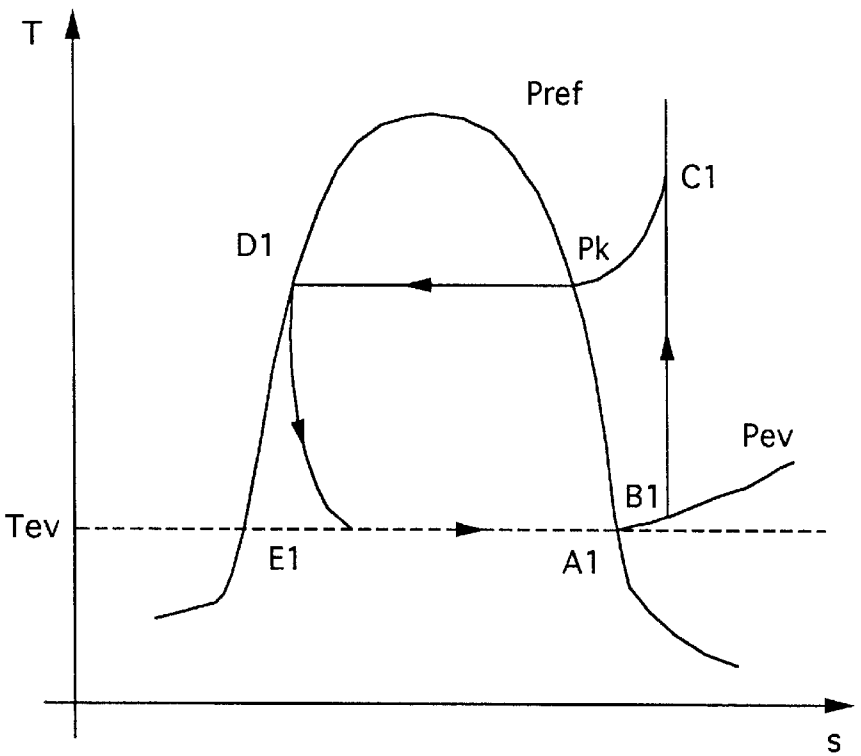
FIG. 1A shows the diagram for a conventional cooling system and the thermodynamic cycle of the said system is shown in FIG. 1B in a temperature entropy (T-s) diagram.
Figure 1A:
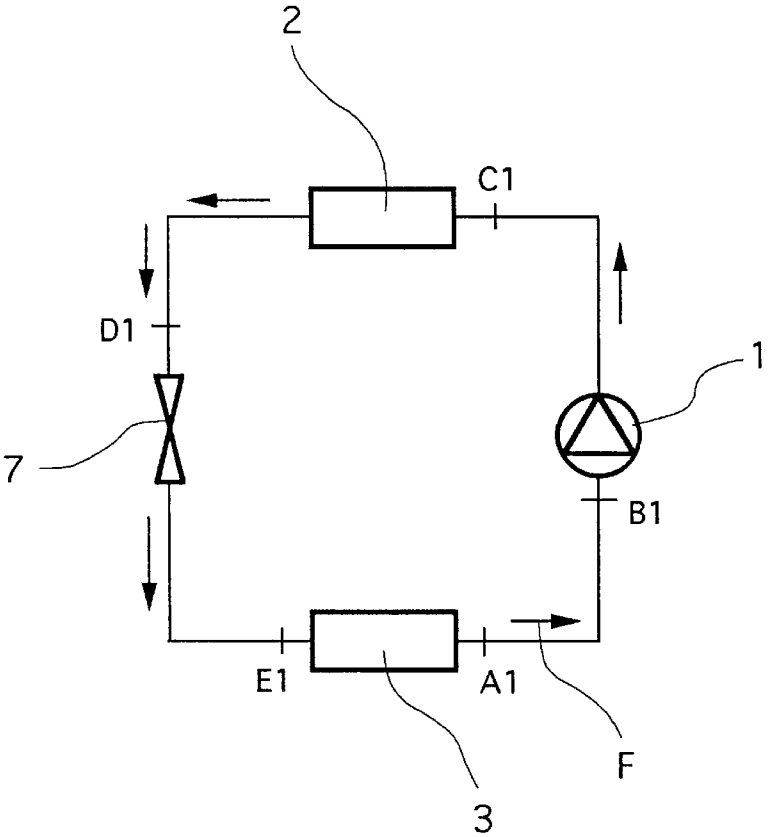

FIG. 1A shows the four conventional components of a cooling system, namely a compressor 1, a condenser 2, a pressure reducer 7 and an evaporator 3. The thermodynamic diagram in FIG. 1B represents the five characteristic points of the cycle. Point A1 is at the outlet from evaporator 3, point B1 is at the inlet to compressor 1, point C1 is at the inlet to condenser 2, point D1 is at the inlet to pressure reducer 7, and point E1 is at the inlet to evaporator 3. These points will be used as references for the calculations presented below.

Consider a domestic refrigerator for which the operating conditions are defined by a cycle for which the evaporation temperature is −15° C. and the condensation temperature is 40° C. Inside the refrigerator, the difference between the evaporation temperature and the average air temperature is 20 K, and the difference between the average room temperature and the condensation temperature is 15 K. Table 1 shows values of thermodynamic variables used to calculate the COP of the system using R134a (CH2FCF3, tetra-fluoro-di-hydro-ethane) as the cooling fluid. This fluid is an HFC (hydro-fluoro-carbide) and is the most frequently used fluid for domestic cooling and for automobile air conditioning.

TABLE 1

| Point | T (° C.) | P (bars) | H (kJ/kg) | R (kJ/kg · K) |
|---|---|---|---|---|
| A1 | −15 | 1.64 | 388.3 | 1.732 |
| B1 | 5 | 1.64 | 405.4 | 1.7959 |
| C1 | 65.5 | 10.17 | 447.1 | 1.7959 |
| D1 | 35 | 10.17 | 248.8 | 1.1661 |
| E1 | −15 | 1.64 | 248.8 | 1.1915 |

The calculations are based on the following assumptions:

- the temperature increase of the cooling fluid between the evaporator outlet A1 and the compressor inlet B1 is 20 K;
- the supercooling at the condenser at D1 is 5 K;
- the reference compression is isentropic and an isentropic compression efficiency is used in the calculations;
- the pressure reduction from D1 to E1 is isenthalpic.

The real mechanical work per unit mass (expressed in kJ/kg) is calculated using formula (1) based on the isentropic mechanical work per unit mass and the isentropic efficiency. This calculation is based on an efficiency of 0.86.

$$W_R=W_{is}/\eta_{is}=(h_{C1}-h_{B1})/0.86=48.5\ \text{kJ/kg} \quad (1)$$

$$Q_o=h_{A1}\ h_{E1}$$

$$COP=Q_o/W_R=139.5/48.5=2.87$$

Figure 2B:
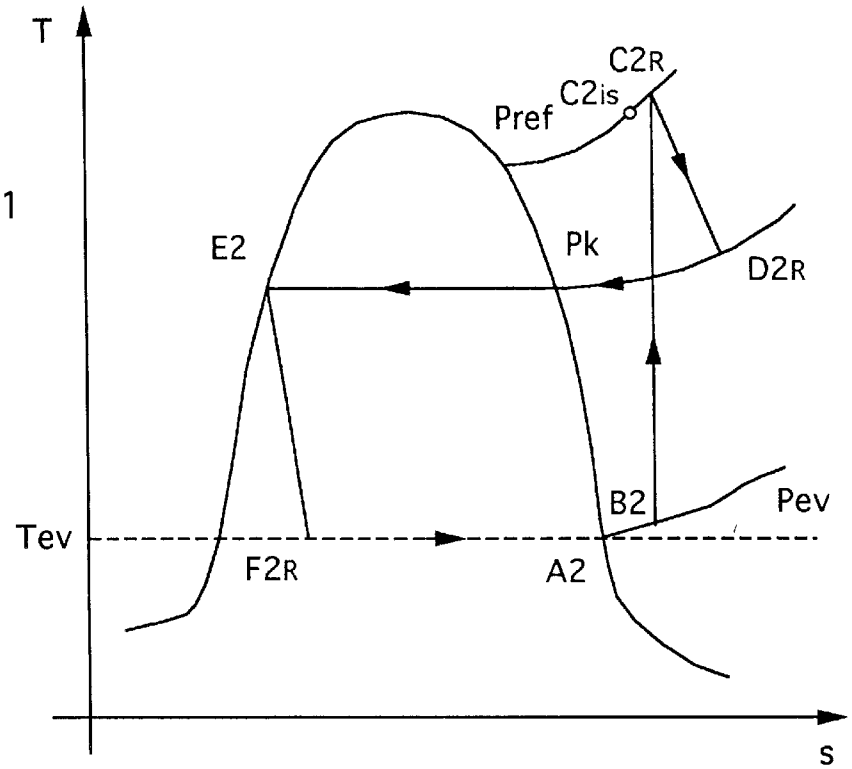
FIG. 2B shows the thermodynamic cycle of the said system in the same T-s diagram.
Figure 2A:
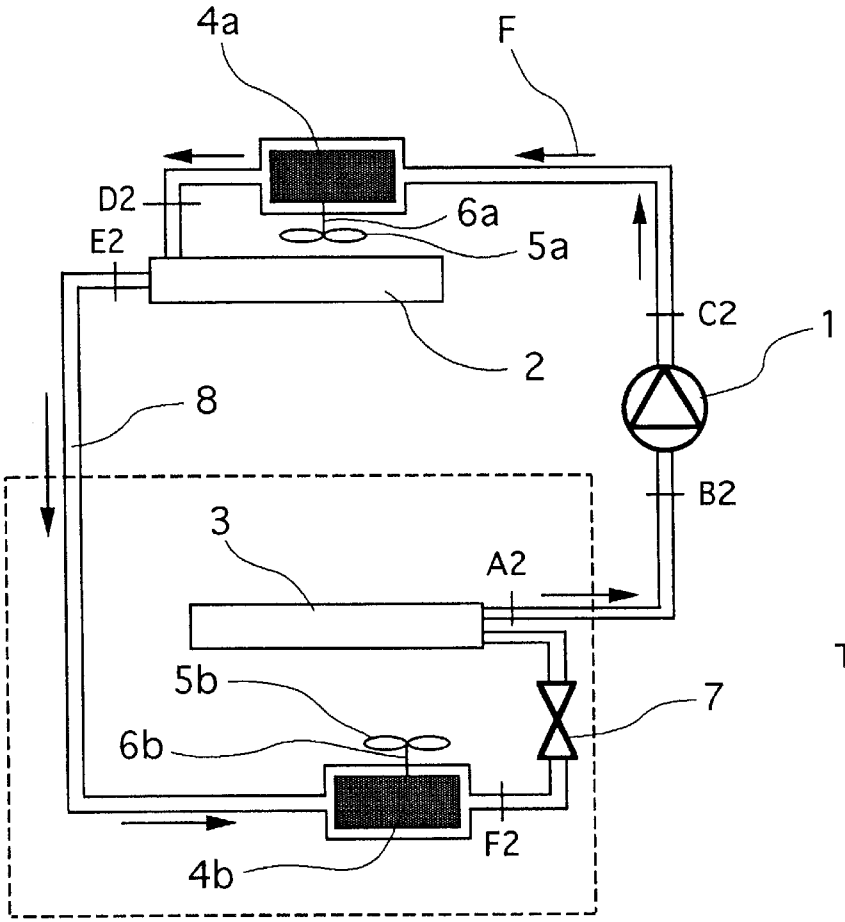
FIG. 2A shows the diagram for a cooling circuit using two turbine-fan units.

FIG. 2*a* shows a first turbine 4*a* (known in itself) that drives a fan 5*a*. This turbine is located between the compressor 1 and the condenser 2. It drives the fan 5*a* and is used to circulate air over the condenser 2. A second liquid-vapour pressure reduction turbine 4*b* is shown in FIG. 2*a*. This two-phase liquid-vapour pressure reduction turbine is located in the part of the circuit in which the liquid phase of the cooling fluid circulates at the outlet from condenser 2. It drives a fan 5*b* that circulates air over the evaporator 3. FIG. 2*b* shows inlet and outlet points of each component in the system in FIG. 2*a*. Point A2 is at the outlet from evaporator 3, point B2 is at the inlet to compressor 1, point $C2_{is}$ is the theoretical outlet point from compressor 1, $C2_R$ is the real outlet point, $D2_R$ is the real outlet point from turbine 4*a*, E2 is the outlet point from condenser 2 (the fluid is in the supercooled state at this point), $F2_R$ is the real outlet point from the two-phase liquid-vapour expansion turbine 4*b*. In this example, complementary pressure reduction using a optional pressure reducer 7 is ignored.

Table 2 shows the thermodynamic variables at these various points in order to calculate the performance coefficient of the system provided with these two fan turbines.

In a system equipped with two fan turbines, the fans reduce the temperature variations. Firstly, the difference in the evaporation temperature and the average air temperature in the refrigerator compartment is reduced to 10 K (instead of 20 K) for the conventional cycle. Secondly, the condensation temperature in the condenser is 35° C. instead of 40°

C. The condenser outlet temperature is 32° C. instead of 35° C., therefore supercooling is only 3 K. Table 2 shows the thermodynamic variables of the different points corresponding to FIG. 2*b* and calculated for R134a;

TABLE 2

| Point | T (° C.) | P (bars) | H (kJ/kg) | S (kJ/kg · K) |
|---|---|---|---|---|
| A2 | −5 | 2.435 | 394.3 | 1.7249 |
| B2 | 15 | 2.435 | 412.2 | 1.7894 |
| $C2_{is}$ | 63.5 | 10.17 | 444.9 | 1.7894 |
| $C2_{real}$ | 70 | 10.17 | 452.2 | 1.8107 |
| $D2_{is}$ | 65 | 8.87 | 448.9 | 1.8107 |
| E2 | 32 | 8.87 | 244.4 | 1.152 |
| F2 | −5 | 2.435 | 240.6 | 1.152 |

In the same way as before, the real compression work is calculated assuming an isentropic compression efficiency that in this case is assumed to be equal to 0.82, allowing for the compression ratio.

$$W_R = W_{is}/\eta_{is} = (h_{CI} - h_{BI})/0.82\,(444.9 - 412.2)/0.82$$

$$= 40\ \text{kJ/kg}\,(1)$$

The COP is also calculated.

$$Q_o = h_{A1} - h_{E1}$$

$$COP = Q_o/W_R = (394.3 - 240.6)/40 = 3.84$$

The COP is improved by about 34%, as a result of two physical phenomena:

the fans are used to reduce temperature differences between fluid phase change temperatures and average outside air temperatures;

isentropic pressure reduction in the two-phase turbine 4*b*, enables recovery of the mechanical work available, unlike what happens with isenthalpic pressure reduction in normal systems.

A distinction has to be made between turbines 4*a* and 4*b*. Turbine 4*a* consumes mechanical energy to be generated by the compressor, but this additional mechanical energy can be compensated by the reduction in the temperature difference between the cooling fluid and the air at the condenser. However, turbine 4*b* does not consume any additional mechanical energy, on the contrary it uses mechanical energy that is available, and the COP of the cycle is directly improved.

Assuming that the pressure reduction efficiency is 0.7, the available mechanical work per unit mass is 2.3 kJ/kg and 2.7 kJ/kg for turbines 4*a* and 4*b* respectively. The flow of R134a for a cooling power of the order of 60 W (typical of many refrigerators) is about 0.4 g/s. The mechanical ventilation power available from the two turbines 4*a* and 4*b* is 0.9 W and 1 W respectively, which is the order of magnitude of the mechanical power of fans necessary for air circulation over exchangers.

Figure 4:
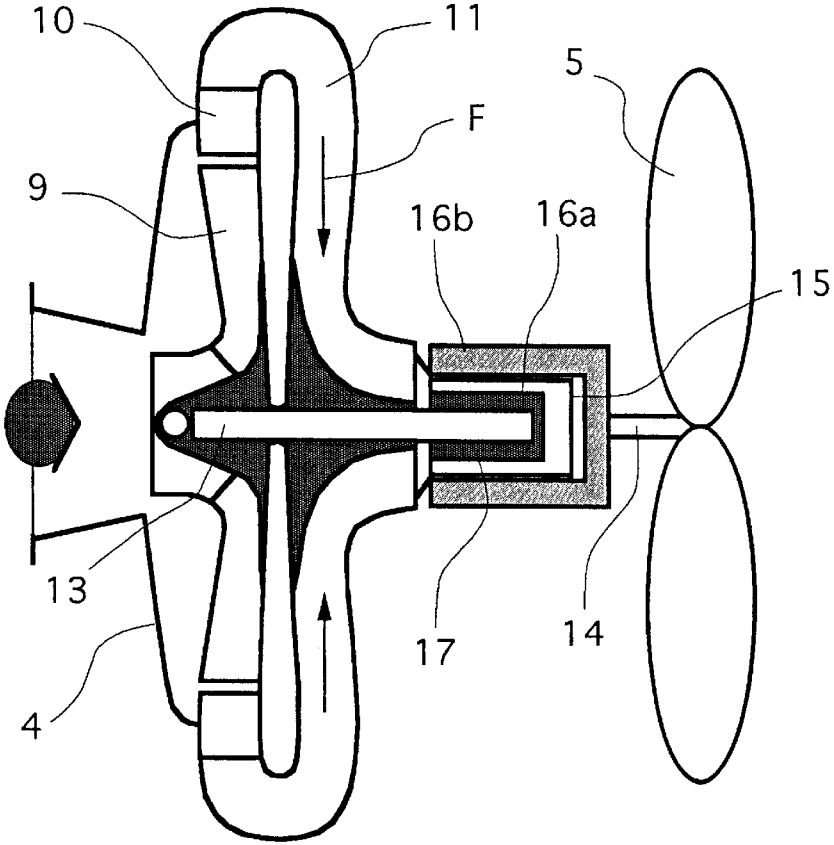
FIG. 4 shows another variant with a magnetically coupled drive enabling better leak tightness.
Figure 3:
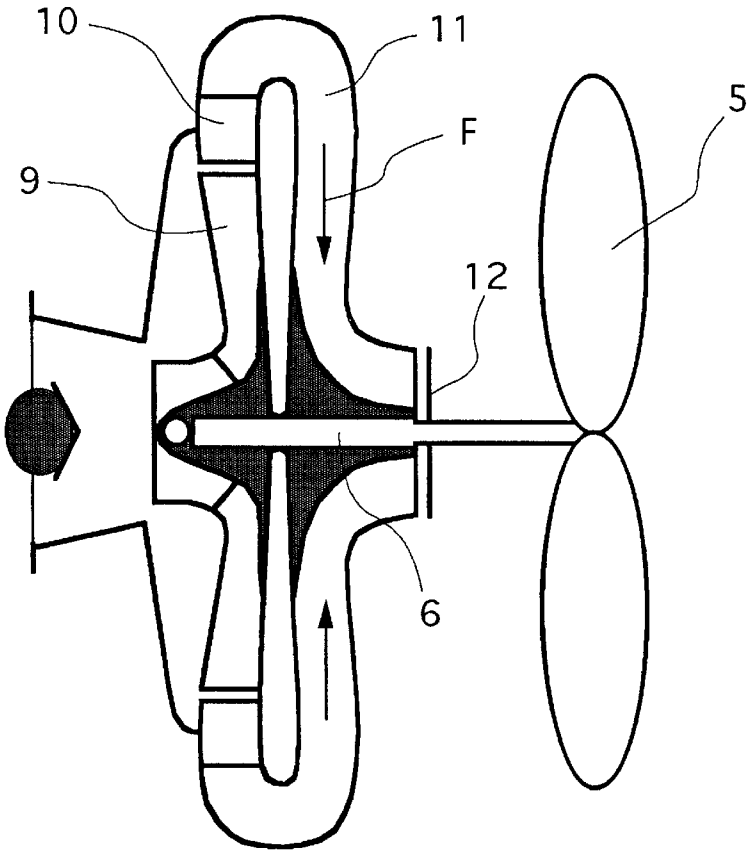
FIG. 3 shows a detailed view of the turbine-fan unit with direct drive and with a seal.

We will now describe FIG. 3 that shows a detailed view of a turbine fan 4*a* or 4*b*. This figure clearly shows the turbine wheel 9, the diffuser 10, the outlet channel 11. The turbine produces mechanical energy that is used directly to drive the fan wheel 5. It is driven on the same spindle 6 (spindle 6*a* for turbine 4*a*, spindle 6*b* for turbine 4*b*, FIG. 2*a*). A seal 12 provides leak tightness between the inside circuit and the outside volume. FIG. 4 clearly shows the same components but for leak tightness reasons, the drive of fan 5 fitted on spindle 14 is magnetic (internal core 16*a* fixed to the turbine spindle 13, the external ring 16*b* fixed to the spindle 14 of fan 5, the air gap 17). This magnetic drive gives an absolutely leak tight surface 15. Arrows shown on the drawings, like F, indicate the direction of fluid circulation.

What is claimed is:

1. System comprising at least one exchanger-evaporator comprising an evaporator; the system using a cooling fluid circulating in a circuit following a thermodynamic cycle comprising at least one liquid-vapor expansion phase;

the system being characterized in that the liquid-vapor expansion phase is achieved using a two-phase turbine operating as a pressure reducer, activating a fan driving air circulation over the exchanger-evaporator; the two-phase turbine being located on the part of the circuit in which the cooling fluid liquid phase circulates.

2. System according to claim 1, making use of a sequence of devices including a compressor, a first exchanger comprising a condenser, and a second exchanger comprising an evaporator;

the system being such that it comprises a liquid-vapor pressure reduction phase made using a two-phase turbine acting as a pressure reducer, driving a fan forcing air circulation over the evaporator and/or the condenser; the two-phase turbine being located on the part of the circuit in which the liquid phase of the cooling fluid outlet from the condenser is free to circulate.

3. System according to claim 1, using a system of devices comprising a compressor, a first exchanger acting as a condenser, a second exchanger acting as an evaporator; and characterized in that it comprises:

a first turbine on a downstream side of the compressor activating a first fan driving air circulation over the condenser, and a second two-phase turbine acting as a pressure reducer and driving a second fan forcing air circulation over the evaporator.

4. System according to claim 3, in which:

a spindle of the turbine controlling pressure reduction of the cooling fluid passes through a turbine body, and a seal is provided between the turbine spindle and the body of the turbine.

5. System according to claim 4, in which:

the turbine controlling the pressure reduction of the cooling fluid drives the second fan through a magnetic drive providing a seal between the turbine body and the turbine spindle.

6. Process for production of cold or heat using a cooling fluid, circulating in a cooling circuit comprising a condenser according to a thermodynamic cycle comprising at least a liquid-vapor expansion phase, the characteristic step consisting of performing the liquid-vapor expansion using a two-phase turbine activating a fan driving an air circulation over an air exchanger—evaporator; the two-phase turbine being located in the part of the circuit in which the liquid phase of the cooling fluid outlet from the condenser circulates.

7. System according to claim 3, in which:

the turbine controlling the pressure reduction of the cooling fluid drives the second fan through a magnetic drive providing a seal between a body of the turbine and a spindle of the turbine.

8. System according to claim 2, in which:

a spindle of the turbine controlling the pressure reduction of the cooling fluid passes through a body of the turbine, and a seal is provided between the turbine spindle and the body of the turbine.

9. System according to claim 8, in which:

the turbine controlling the pressure reduction of the cooling fluid drives the fan through a magnetic drive providing a seal between the turbine body and the turbine spindle.

10. System according to claim 2, in which:

the turbine controlling the pressure reduction of the cooling fluid drives the fan through a magnetic drive providing a seal between a body of the turbine and a spindle of the turbine.

11. System according to claim 1, in which:

a spindle of the turbine controlling the pressure reduction of the cooling fluid passes through a body of the turbine, and a seal is provided between the turbine spindle and the body of the turbine.

12. System according to claim 11, in which:

the turbine controlling the pressure reduction of the cooling fluid drives the fan through a magnetic drive providing a seal between the turbine body and the turbine spindle.

13. System according to claim 1, in which:

the turbine controlling the pressure reduction of the cooling fluid drives the fan through a magnetic drive providing a seal between a body of the turbine and a spindle of the turbine.

14. The system of claim 1 embodied as a cooling or air conditioning system.

15. The system of claim 2 embodied as a cooling or air conditioning system.

16. The system of claim 3 embodied as a cooling or air conditioning system.

17. The system of claim 4 embodied as a cooling or air conditioning system.

18. The system of claim 5 embodied as a cooling or air conditioning system.

19. The system of claim 7 embodied as a cooling or air conditioning system.

* * * * *